US007950310B2

(12) United States Patent
Hung

(10) Patent No.: US 7,950,310 B2
(45) Date of Patent: May 31, 2011

(54) MAGNETIC STRUCTURE FOR A SOCKET

(76) Inventor: Cheng Hao Hung, Taichung County (TW)

( * ) Notice: Subject to any disclaimer, the term of this patent is extended or adjusted under 35 U.S.C. 154(b) by 3 days.

(21) Appl. No.: 12/564,918

(22) Filed: Sep. 23, 2009

(65) Prior Publication Data

US 2011/0067532 A1 Mar. 24, 2011

(51) Int. Cl.
*B25B 13/06* (2006.01)

(52) U.S. Cl. ..... 81/125

(58) Field of Classification Search ..... 81/125, 81/180.1, 121.1, 451
See application file for complete search history.

(56) References Cited

U.S. PATENT DOCUMENTS

| | | | | |
|---|---|---|---|---|
| 3,834,253 | A * | 9/1974 | Carr | 81/125 |
| 5,542,320 | A * | 8/1996 | Vasichek et al. | 81/125 |
| 6,164,168 | A * | 12/2000 | Anderson | 81/125 |
| 6,374,709 | B1 * | 4/2002 | Vasichek et al. | 81/125 |
| 7,290,467 | B2 * | 11/2007 | Harker | 81/125 |

* cited by examiner

*Primary Examiner* — Hadi Shakeri

(57) ABSTRACT

A magnetic structure for a socket includes a containing body made of a soft material. The containing body has an embedding hole defined therein. A magnetic element is received in the embedding hole. The containing body has a plurality of ribs disposed around an outer periphery of the containing body. When the containing body is embedded into the socket, the rib abuts an inner wall of the socket for appropriately adjusting a compression level of the containing body with respect to the inner wall of the socket to securely couple the containing body with the socket.

1 Claim, 5 Drawing Sheets

MAGNETIC STRUCTURE FOR A SOCKET

BACKGROUND OF THE INVENTION

1. Field of the Invention

The present invention related to a magnetic structure, and more particularly to a magnetic structure for a socket.

2. Description of Related Art

A conventional magnetic tool entitled "Magnetic keeper accessory for wrench socket" discloses a magnetic keeper accessory applied to a wrench having a ratchet socket on an internal wall of the wrench. The magnetic keeper accessory includes a socket and an accessory, the socket includes a ratchet driving hole and a through hole interconnected to the interior of the socket, and the through hole has a diameter smaller than the diameter of the ratchet driving hole, and accessories include a first portion having a diameter corresponding to the ratchet driving hole and a second portion having a diameter corresponding to the through hole, such that the accessories are embedded into the through hole through the second portion, and the outer periphery of the first portion is compressed by an internal wall of the ratchet driving hole to achieve the effect of coupling the socket. The accessories include a containing hole for embedding and fixing a magnet, such that a locking element is inserted into the socket and attached by the magnet for facilitating the locking operation.

However, although the conventional magnetic tool can provide a magnetic attraction function to facilitate fixing the locking element with the socket, or facilitate picking up a locking element that has fallen into a narrow operating space, yet the way of connecting the socket still requires improvements for the following three reasons:

1. The accessories are embedded into the through hole and fixed into the socket by the force of pressing the internal wall, but the accessories do not have any structural device that can be contracted or extended appropriately to match the level of compression against the internal wall of the socket, and thus the accessories are engaged closed when the accessories are entered into the socket. If the accessories are installed or pressed, the accessories will be tilted with respect to the internal wall of the socket internal wall by a non-uniform force. Since there is no appropriate contraction or extension for making adjustment with respect to the level of compression against the internal wall of the socket, therefore the accessories may be compressed by the non-uniform force and squeezed out from the containing hole by forces. As a result, users have to remove the accessories by a magnet and reinstall the accessory, and such arrangement makes the locking operation very inconvenient.

2. Since the accessories of the conventional magnetic tool is fixed with the internal wall of the socket by a compression, and a vent hole formed on a side of a second embedding portion is provided for releasing the pressure to attempt reducing the effect of the pressing force and the deformation of the accessories with respect to the compression level of the magnet and the internal wall of the socket internal. In fact, when a force is exerted onto the socket to press and rotate the locking element or connecting an object, the pressure of the locking element exerted onto the accessories still produce a deformation at another end without a direct contact of the locking element, such that the accessories are in a protruding form, and the deformation occurred at distal ends of the accessories will produce a force of pressing the accessories with the internal wall of the socket internal wall, and the accessories will be separated from the pressing position at the internal wall of the socket internal wall, or the accessories will be loosened, and no longer can be connected with the socket securely.

3. Since the accessories are embedded into the internal wall of the socket, but there is no structural device for assisting the accessories to be entered into the socket, therefore the accessories may be tilted with respect to the socket, or may get stuck. Thus, a reinstallation is required, and thus makes the installation more difficult.

The present invention has arisen to mitigate and/or obviate the disadvantages of the conventional bicycle speed change operation assembly.

SUMMARY OF THE INVENTION

The main objective of the present invention is to provide an improved magnetic structure for a socket.

To achieve the foregoing objective, the present invention provides a magnetic structure for a socket comprising a containing body made of a soft material and embedded into a socket and a magnetic element.

The containing body includes an embedding hole formed at the center of the containing body and provided for containing the magnetic element, and a press flange disposed at least one end of the embedding hole and abutted against a magnetic element for preventing the magnetic element from being separated, such that when the magnetic element is entered into the embedding hole, the press flange will limit the position of the magnetic element.

The containing body includes plurality of ribs disposed at the outer periphery of the containing body. When the containing body is embedded into the socket, the ribs are provided for abutting an inner wall of the socket. The ribs are substantially in a convexly curved shape, and the purpose of designing the ribs into the convexly curved shape is to allow the middle of the convexly curved structure of the rib to be contacted with the inner wall of the socket, so that the force pressing the ribs and the socket with each other can be extended uniformly inward or outward and transmitted to the central position of the convexly curved structure.

Further benefits and advantages of the present invention will become apparent after a careful reading of the detailed description with appropriate reference to the accompanying drawings.

DETAILED DESCRIPTION OF THE INVENTION

Figure 1:
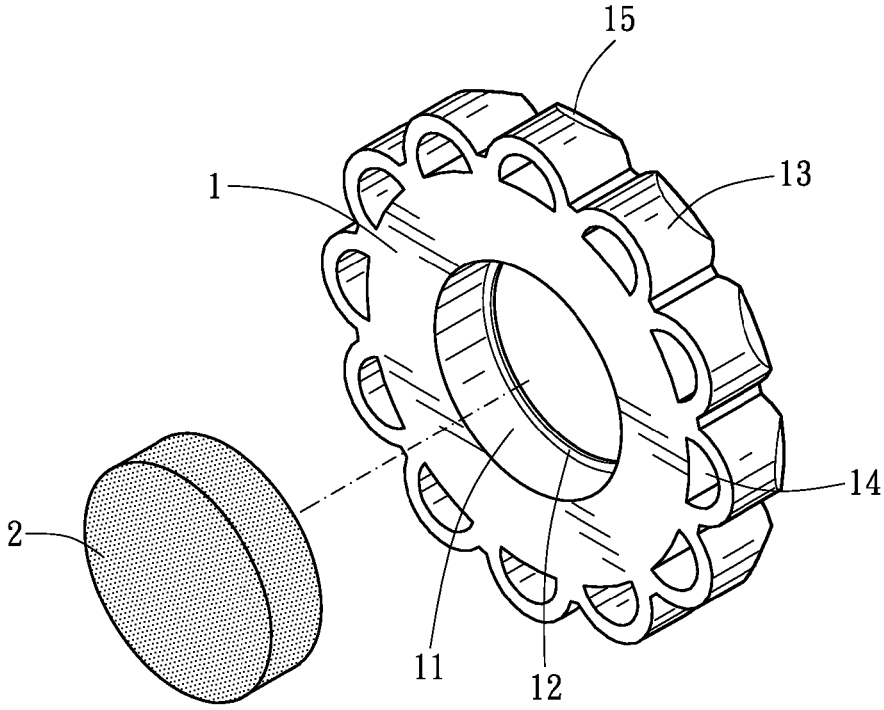
FIG. 1 is an exploded view showing components of a magnetic structure for a socket in accordance with a first preferred embodiment of the present invention.
Figure 2:
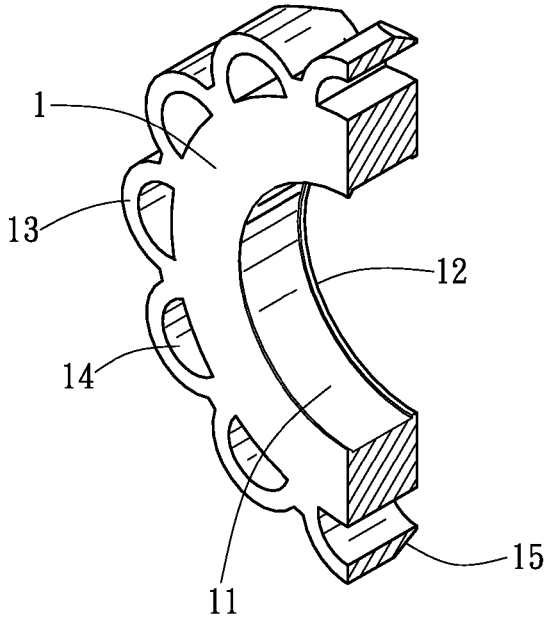
FIG. 2 is a cross-sectional view of a half of a magnetic structure for a socket in accordance with a first preferred embodiment of the present invention.
Figure 3:
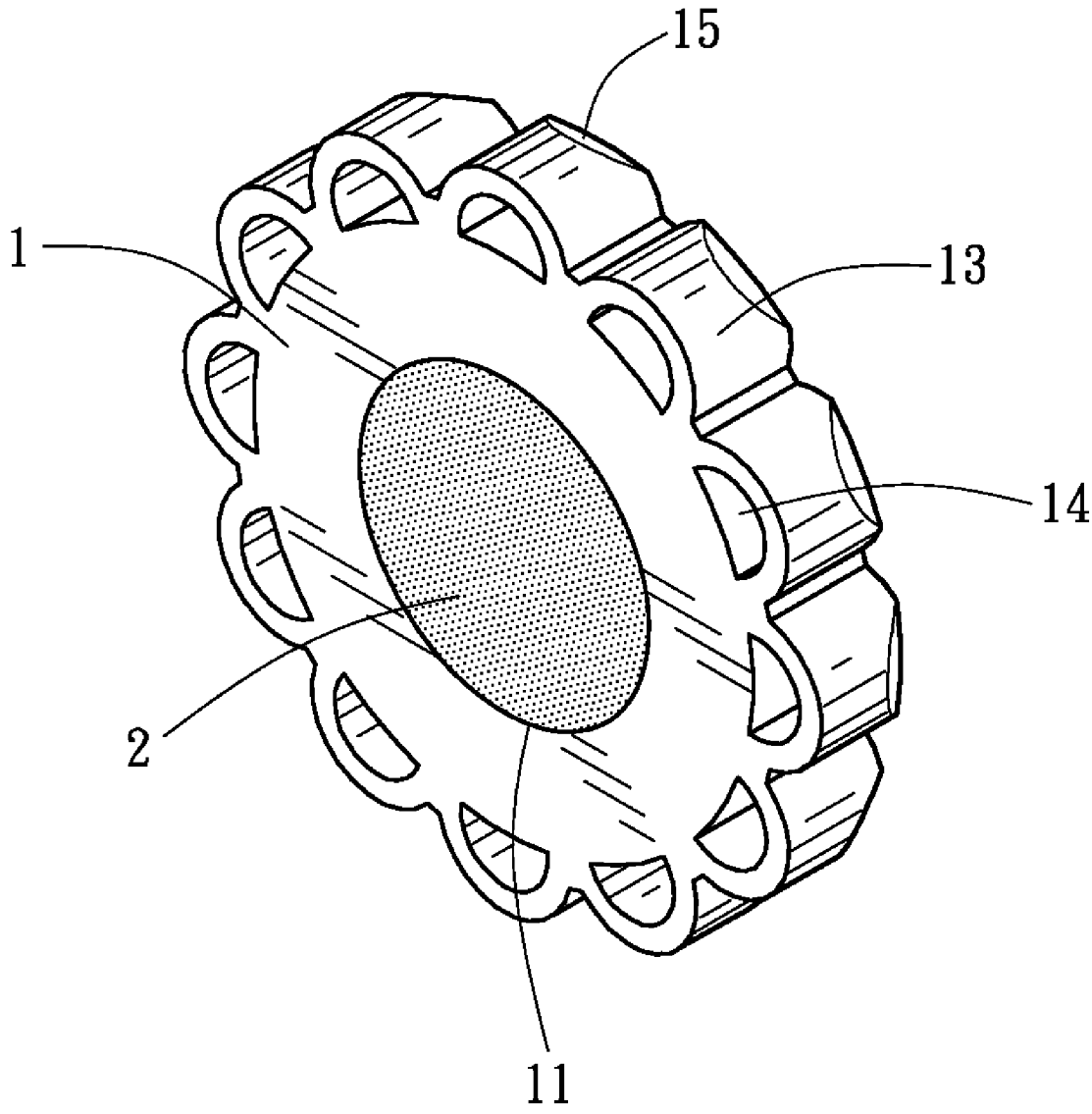
FIG. 3 is a perspective view of a magnetic structure for a socket in accordance with a first preferred embodiment of the present invention.

Referring to the drawings and initially to FIGS. 1 to 3 for a magnetic structure for a socket in accordance with a first preferred embodiment of the present invention, the magnetic structure for a socket comprises a containing body 1 made of a soft material and embedded into a socket, and a magnetic element 2.

The containing body 1 is substantially in the shape of a circular disc, and includes an embedding hole 11 at the center of the containing body 1, for accommodating the magnetic element 2, and a press flange 12 disposed at least one end of the embedding hole 11 of the containing body 1 and abutted against the magnetic element 2 for preventing a dislocation of the magnetic element 2, such that when the magnetic element 2 is entered into the embedding hole 11, the press flange 12 can provide the effects of limiting the position of the magnetic element 2, such that the magnetic element 2 will not fall out from the embedding hole 11 easily.

The containing body 1 includes plurality of ribs 13 disposed at an outer periphery of the containing body 1, such that when the containing body 1 is embedded into the socket, the ribs 13 are provided for abutting the inner wall of the socket, wherein the ribs 13 of this preferred embodiment are arranged equidistantly from the outer periphery of the containing body 1, and are substantially in a convexly curved shape. The purpose of having the ribs 13 in a convexly curved shape is to contact the middle of the convexly curved structure of the ribs with the inner wall of the socket, so that the force of the ribs 13 and the socket abutting with each other can be extended uniformly inward or outward from the central position of the convexly curved structure. If any other shape of the rib 13 is used, then the transmission of force may be non-uniform, and will not be better than the convexly curved shaped structure, and thus the ribs 13 are designed in this shape to provide a better force exertion effect.

Since the ribs 13 and the containing body 1 are made of a soft material, the compression force of the ribs 13 between the containing body 1 and the inner wall of the socket produce an appropriate deformation when the containing body 1 is embedded into the socket, so that the containing body 1 can be adjusted to a better pressing position with respect to the inner wall of the socket through the deformation of the rib 13, and allow the containing body 1 to be entered and fixed into the socket smoothly. Even if a pushing force is exerted onto the containing body 1, the deformation of the pressed ribs 13 can extend the containing body 1 to an appropriate level to provide a sufficient space for the transmission, such that the containing body 1 will not be separated from the inner wall of the socket easily, or the magnetic element 2 will not be compressed to fall out easily, so as to provide a secured connection of the containing body 1 with the socket.

In this preferred embodiment, the containing body 1 further includes a containing hole 14 separately formed on an inner side of the ribs 13 for providing a sufficient space for the deformation of the ribs 13, so that when a rib 13 is pressed, the rib 13 is deformed and withdrawn towards the interior of the containing body 1, and the containing hole 14 will be compressed into a smaller size. With an appropriate deformation of the ribs 13 without over-pressing the containing body 1 or separating the containing body 1 from the inner wall of the socket inner wall. The rib 13 includes a chamfer 15 (which is in an aslant planar shape in this preferred embodiment) at least one end of the rib 13, such that when it is necessary to install the containing body 1 into the socket, the chamfer 15 can abut the outer periphery of an end of the socket, and user can insert the containing body 1 into the socket while the chamfer 15 is abutting the end of the socket, so as to achieve the effect of assisting the containing body 1 to be embedded with the socket and making the installation of the containing body 1 into the socket easier.

Figure 4:
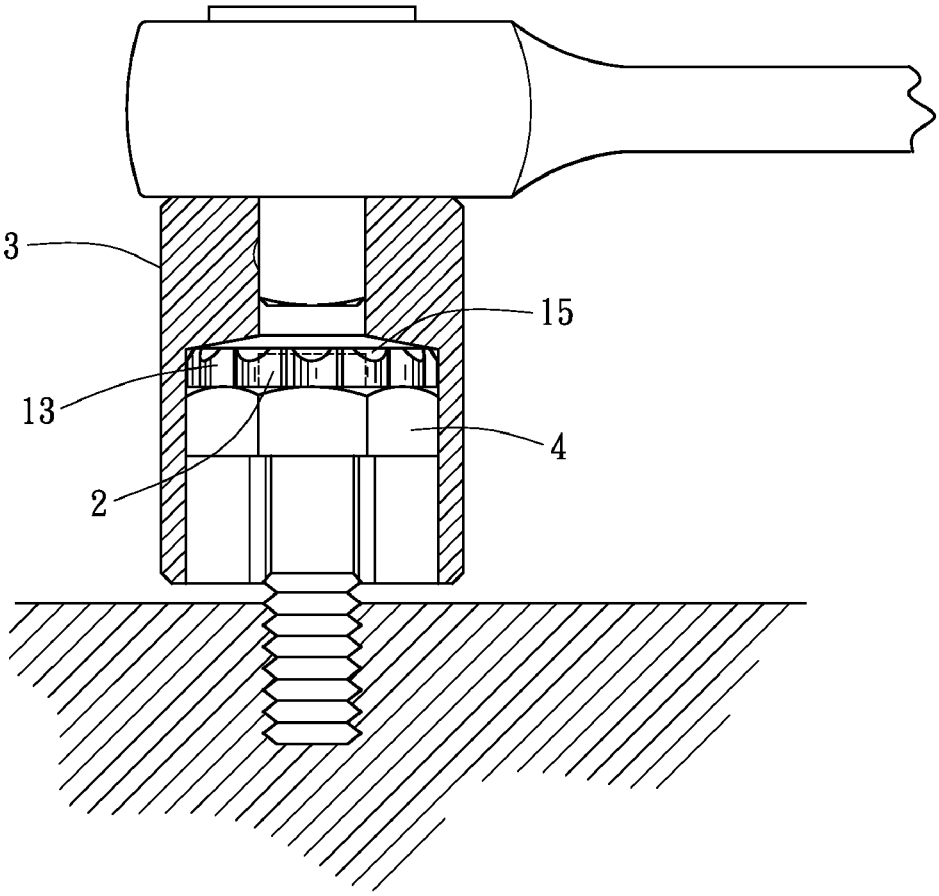
FIGS. 4 and 5 are schematic views of installing a magnetic structure for a socket into a socket in accordance with a first preferred embodiment of the present invention.
Figure 5:
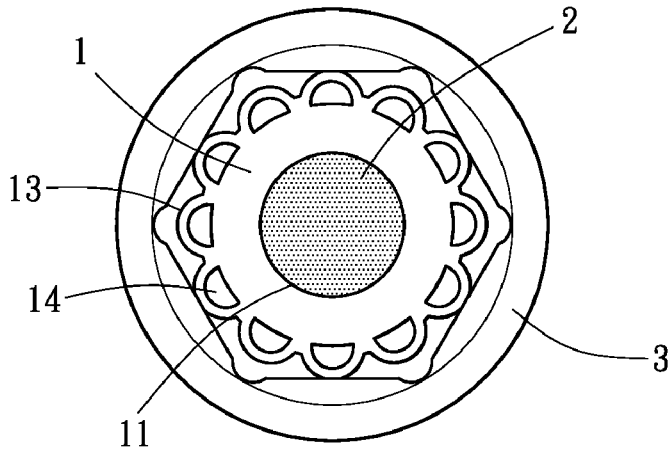

With reference to FIGS. 4 and 5, the containing body 1 is embedded into a socket 3, and the ribs 13 at the outer periphery of the containing body 1 is pressed against the inner wall of the socket 3, and the position of the containing body 1 pressing the inner wall of the socket 3 is adjusted appropriately by the sufficient deformation provided by the rib 13, and a magnetic element 2 is installed in the embedding hole 11 the center of the containing body 1 for providing the effect of attaching the locking element 4 to facilitate the user's operation.

Figure 6:
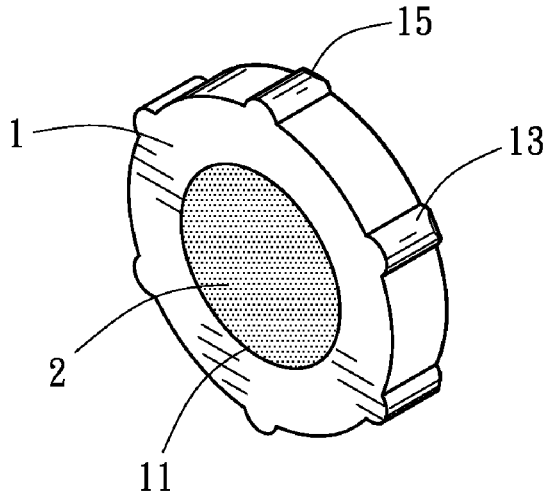
FIGS. 6 and 7 are schematic views of a magnetic structure for a socket in accordance with a second preferred embodiment of the present invention.
Figure 7:
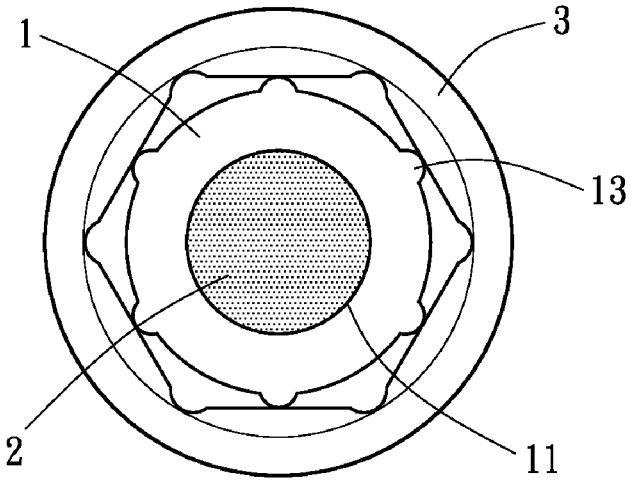

With reference to FIGS. 6 and 7 for a magnetic structure for a socket in accordance with a second preferred embodiment of the present invention, this preferred embodiment is substantially the same as the first preferred embodiment with the following structural difference.

In the second preferred embodiment as shown in FIGS. 6 and 7, the containing body 1 may have no containing hole 14, since the ribs 13 can provide a sufficient deformation and allow the containing body 1 to make an appropriate adjustment for level of compression against the inner wall of the socket 3 by the ribs 13, and the containing body 1 will not be over-pressed to deviate or detach the socket 3.

Figure 8:
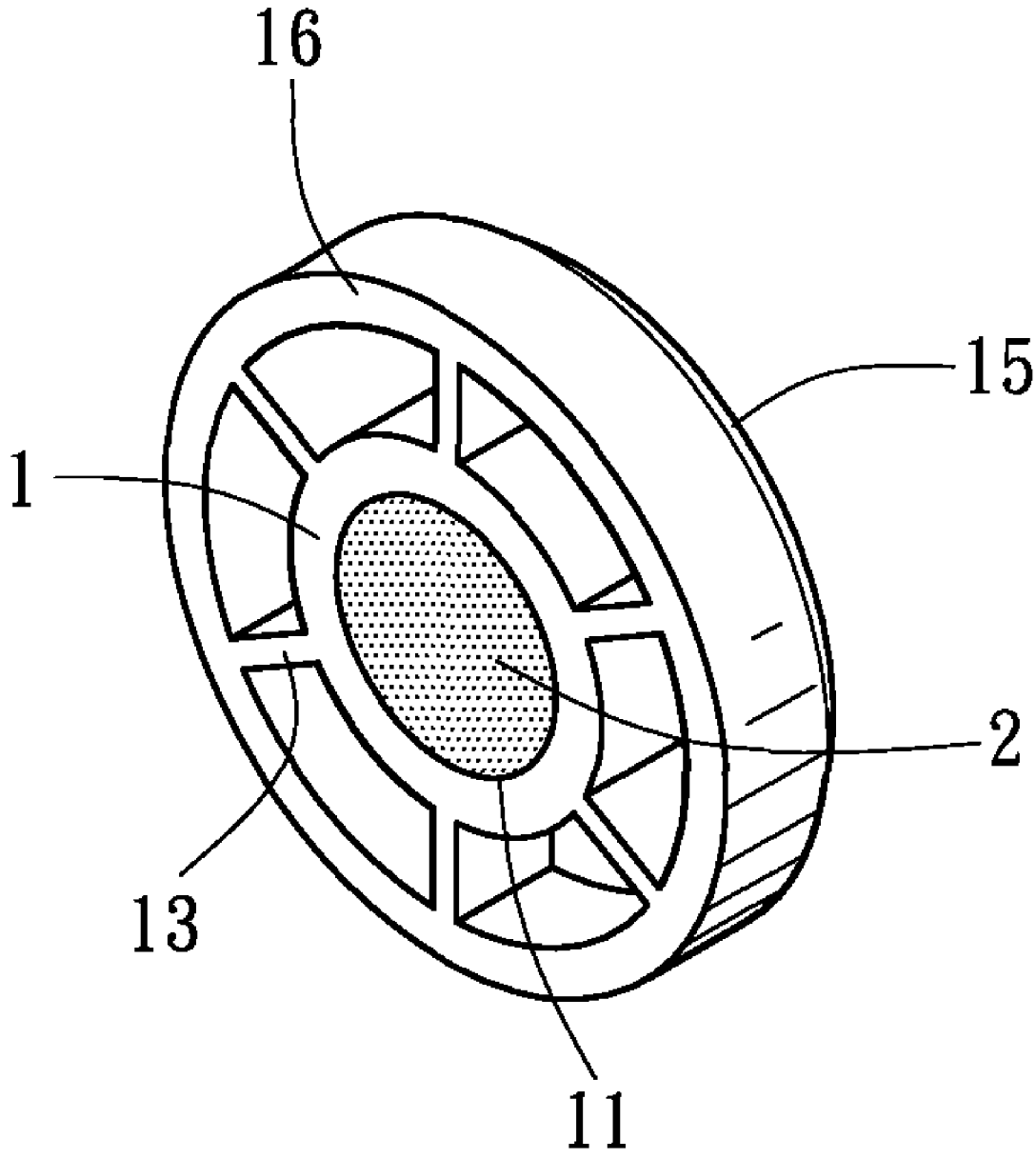
FIG. 8 is a schematic view of a magnetic structure for a socket in accordance with a third preferred embodiment of the present invention.

In the third preferred embodiment as shown in FIG. 8, the containing body 1 includes a press ring 16 disposed at the outer periphery of the containing body 1 and coupled to each rib 13 for defining a penetrating open-end space between the press ring 16 and the rib 13, and a side of the press ring 16 can be tilted to the chamfer 15 of the rib 13, such that when the containing body 1 is entered into the socket, the press ring 16 can be used for assisting the compression and deformation of the ribs 13 to provide the effect of adjusting the level of compression of the containing body 1 against the inner wall of the socket.

With the aforementioned structural deign of the present invention, the invention has the following advantages:

1. The purpose of installing the ribs 13 is to provide sufficient deformations for entering the containing body 1 into the socket 3, so that the containing body 1 is abutted against the inner wall of the socket 3 by the deformation of the ribs 13 to make an adjustment for a better embedding position. Therefore, the containing body 1 and the inner wall of the socket 3 will not be engaged too closely, when the containing body 1 is embedded into the socket 3, because the containing body 1 does not have extra space for the deformation, and the inner wall of the socket 3 is compressed and tilted, or the magnetic element 2 is squeezed out from the embedding hole 11, and thus the rib 13 can provide a positioning effect and adjusting the compression level of the containing body 1.

2. If the containing body 1 is pressed by the locking element 4, the containing body 1 will be pressed and loosened. Now, the ribs 13 can be deformed appropriately according to the pressure to release the loosening state of the containing body 1 caused by the pressure, so that the inner wall of the socket 3 will not be forced by the containing body 1, or the magnetic element 2 will be forced out from the embedding hole 11 since the deformation cannot be released. Therefore, the ribs 13 not just adjust the compression level of the containing body 1 against the socket 3 only, but also provide a space for release the loosened state of the containing body 1, so that the containing body 1 will not be separated from the socket 3 easily by outer forces.

3. The purpose of installing the chamfer 15 is to provide an appropriate action against the ends of the socket 3 when the containing body 1 is embedded into the socket 3, so that the containing body 1 can be entered into the socket 3 without requiring an adjustment of the compression level of the containing body 1 against the inner wall of the socket 3, and the containing body 1 will be deviated from the socket 3 to make the embedment difficult.

Although the invention has been explained in relation to its preferred embodiment, it is to be understood that many other possible modifications and variations can be made without departing from the spirit and scope of the invention as hereinafter claimed.

What is claimed is:

1. A magnetic structure for a socket comprising:

a containing body made of a soft material for adapting to embed into a socket, the containing body having an embedding hole defined therein and a press flange annularly formed on an inner periphery of the embedding hole, a magnetic element received in the embedding hole and abutting against the press flange for preventing the magnetic element from be separated, the containing body having a plurality of ribs disposed around an outer periphery of the containing body, each rib being substantially in a convexly curved shape and having a containing hole defined therein for providing a sufficient space for a deformation of the rib, each rib having a chamfer formed on one end thereof for assisting the containing body to be easily and smoothly inserted into the socket;

wherein the containing body with the magnetic element is adapted to insert into the socket for providing magnetic effect, and each convexly curved-shaped rib has a middle abutting against an inner wall of the socket, such that an abutting force between the socket and each rib is uniformly dispersed from the middle of each rib.

* * * * *